US005941805A

United States Patent [19]

Copelin

[11] Patent Number: 5,941,805

[45] Date of Patent: Aug. 24, 1999

[54] CHILDREN'S WEIGHT LIFTING BAR AND BENCH COMBINATION

[76] Inventor: Dwight Copelin, 956 30th St., West Palm Beach, Fla. 33407

[21] Appl. No.: 08/960,817

[22] Filed: Oct. 30, 1997

[51] Int. Cl.[6] ..... A63B 21/078

[52] U.S. Cl. ..... 482/104; 482/107; 482/106; 446/482

[58] Field of Search ..... 482/104, 106–108, 482/142; 446/479, 482

[56] References Cited

U.S. PATENT DOCUMENTS

| | | | |
|---|---|---|---|
| 46,413 | 2/1865 | Windship | 482/108 |
| 5,484,367 | 1/1996 | Martinez . | |
| 5,611,762 | 3/1997 | Kaye | 482/104 |

*Primary Examiner*—Richard J. Apley
*Assistant Examiner*—John Mulcahy
*Attorney, Agent, or Firm*—McHale & Slavin PA

[57] ABSTRACT

A children's weight lifting set for simulating proper chest muscle exercises includes a bench construction and a lifting rod assembly. A pair of prop arms extends upward from the a support platform of the bench construction. The prop arms include contoured free ends to selectively maintain the lifting rod assembly in a raised position. A set of support legs extending downward from the support platform. The lifting rod assembly includes an elongated bar and a collection of plates. The plates slidably engage mounting regions on the bar and are held in place by retention pins. The plates also include size-indicating indicia and follow a size-indicating color scheme.

8 Claims, 3 Drawing Sheets

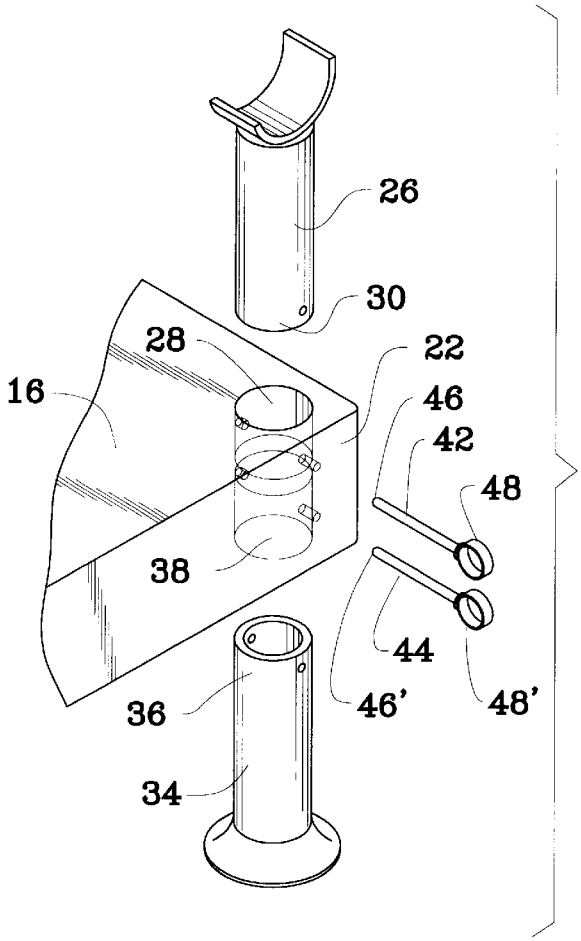
FIG. 3
FIG. 4
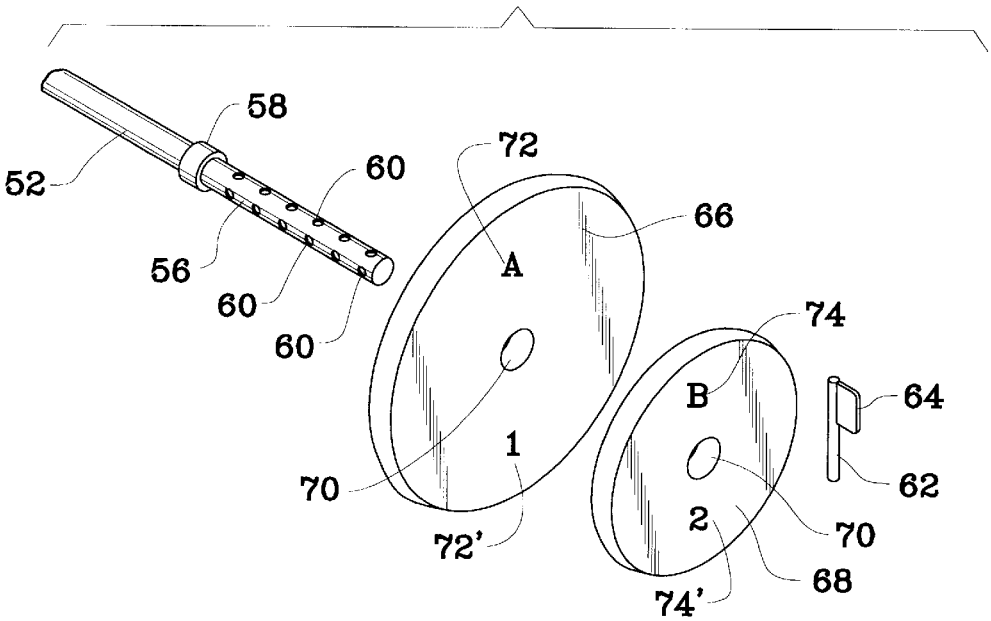

CHILDREN'S WEIGHT LIFTING BAR AND BENCH COMBINATION

FIELD OF THE INVENTION

The present invention relates to children's toys, and particularly to a toy that teaches children proper weight lifting form.

BACKGROUND OF THE INVENTION

Educational toys allow children to learn while being entertained. Many toys are designed to remove the risks involved with activities that may be safe when undertaken by adults, but are dangerous when undertaken by children. Essentially, toys of this type, known collectively as simulators, broaden the acceptable range of activities in which a child may participate. Simulators allow children to experience modified versions of otherwise-dangerous activities.

Typically, simulators fall into one of two broad categories: environment replicators and device replicators. Simulators of the first type imitate dangerous environments, allowing children to explore virtual worlds modeled after real-world locations or situations. These environment replicators allow children to interact with exciting, but potentially-dangerous, settings safely. Other simulators fall within the device replicators of the second category. The second type of simulators imitate devices that would otherwise be dangerous if used by children. These device replicators allow children to pretend they are using otherwise potentially-dangerous equipment. Preferably, such devices teach children the proper habits and techniques for such dangerous equipment. In essence, these devices help prepare youngsters for future use of real versions of the imitated equipment.

Device-replicating simulators often allow children to imitate the use of devices commonly used safely by older role models. In particular, many children have exercise-minded parents and/or siblings who include a weight training program into an exercise regimen. Specialized equipment exists for working different muscle groups within the body. This weight training equipment involves devices for lifting ever-increasing amounts of weight. As such, weight training is an activity that not suitable for most children. For example, weight training may interfere with proper growth of young muscles; lifting too much weight may stunt muscle development. Additionally, the equipment associated with weight training is heavy and, if dropped, presents a very real hazard. Although many children wish to imitate weight training role models, typical weight lifting equipment is not suitable for use by children.

In an effort to allow children the opportunity to safely emulate their older weight lifting counterparts, weight training simulators have been developed. For example, U.S. Pat. No. 5,484,367 discloses a weight set for simulating hand weight exercises. The set presents a solid bar with threaded ends keyed to accept notched weight plates. The set is designed to prevent rotation of the weights about the bar; the bar end sections are shaped to engage cutouts formed integral with mounting bores in the weight plates. Although the '367 device is lightweight, it requires a high degree care and coordination for proper setup. The bar employs retaining collars that screw onto the bar threaded ends. Since the bar is plastic, care must be taken to line up the collars properly, or the threads may become cross-threaded or stripped. Also, child-induced twisting of the '367 plates would produce large amounts of torsional load, leading to fatigue-related failure of the device. Although the '367 device is intended to be a toy, the extra care and coordination required preclude the carefree use typically expected with toys.

In addition, although some weight training simulators exist for children, known simulators are not suitable for allowing bench press emulation. The bench press motion requires that an individual be supported above the ground in a reclined position. This exercise is generally performed with a bench designed to support the lifter's weight and a supply of lifted weights. Unfortunately, known benches are not appropriate for use by children. Known benches are typically metal with a padded, rigid support platform. Because benches used during chest muscle exercises must be sturdy enough to simultaneously support the weight of an individual and the extra load of weights lifted during exercise, they are dangerously heavy. If the heavy bench should topple during use or while a child is climbing aboard, serious injury could result. Additionally, traditional benches are too heavy to be moved into a play area safely by little children. Often the heavy bench is laboriously pushed across a household floor into an area dedicated for play. Such sliding motion commonly leaves scratches on the floor, precluding further use of the bench as a playtime prop. The benches are also not readily dismantled. They require a dedicated area for use and storage. If the bench is not stored properly when not in use, it may invite dangerous, inappropriate use. Random roughhousing with a typically-heavy weight bench could knock it over, causing accidental injury.

Therefore, what is needed in this art is a weight lifting set that allows children to simulate bench press exercise without exposure to the dangers of typical weight lifting equipment. The weight lifting set should have a durable weight securement system and should be designed for selective dismantling for storage. Additionally, the weight lifting set should be formed for easy assembly and disassembly by children without tools or requiring adult supervision.

SUMMARY OF THE INVENTION

The present invention is a children's toy set for simulating chest muscle exercises. The set is made from lightweight plastic and includes a multi-part bench construction having a rectangular support platform characterized by prop arm recesses at one end of an upper surface, and four support leg recess in the corners of a bottom surface.

A pair of prop arms extends upward from the support platform, out of prop arm cavities. Four vertically-oriented support legs extend downward from within the support leg recesses. The prop arms and support legs are held in place by removable bracing pins. The prop arms each have a contoured free end shaped to engage an included lifting rod assembly.

The lifting rod assembly includes an elongated bar and an associated collection of discs. The discs fit within mounting regions on the bar and are held in place with pins that frictionally engage pin bores disposed in the bar.

Therefore, it is an object of the present invention to provide a children's weight training simulator that allows simulation of bench press exercises.

It is an additional object of the present invention to provide a children's weight training simulator that is lightweight and eliminates dangers of dropping associated with known bench press equipment.

It is still a further object of the present invention to provide a children's weight training simulator that has a durable weight securing system suited for use by children.

It is yet another object of the present invention to provide a children's weight training simulator that may be dismantled easily for storage.

It is a further object of the present invention to provide a children's weight training simulator that may be repeatedly assembled and disassembled by children without requiring tools or adult supervision.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWING

FIG. 3 is a close-up partial view a corner of the bench construction of the present invention; and FIG. 4 is a close-up partial view of the lifting bar assembly of the present invention.

DETAILED DESCRIPTION OF THE INVENTION

Figure 1:
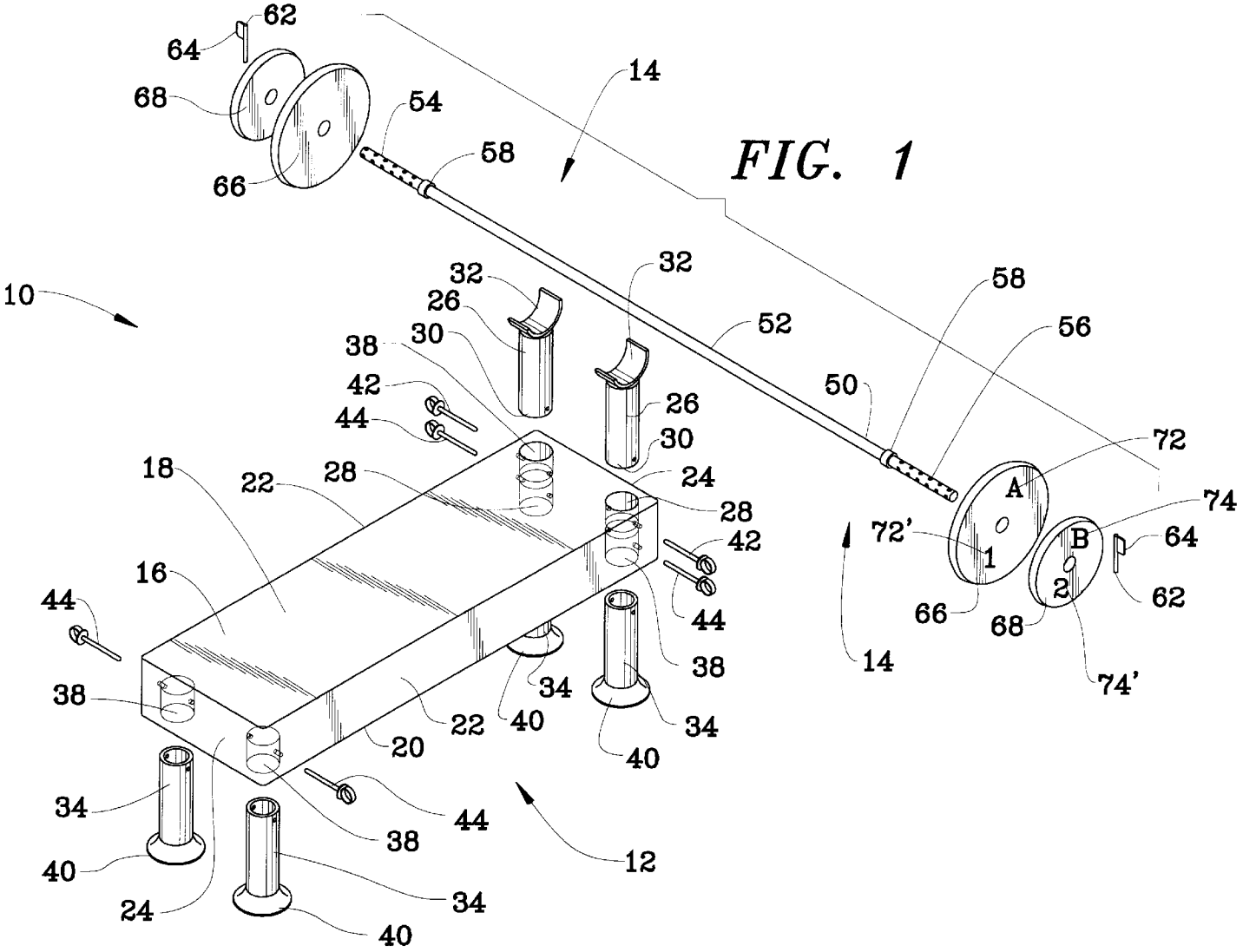
FIG. 1 is an exploded perspective view of the weight lifting simulator combination of the present invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 2:
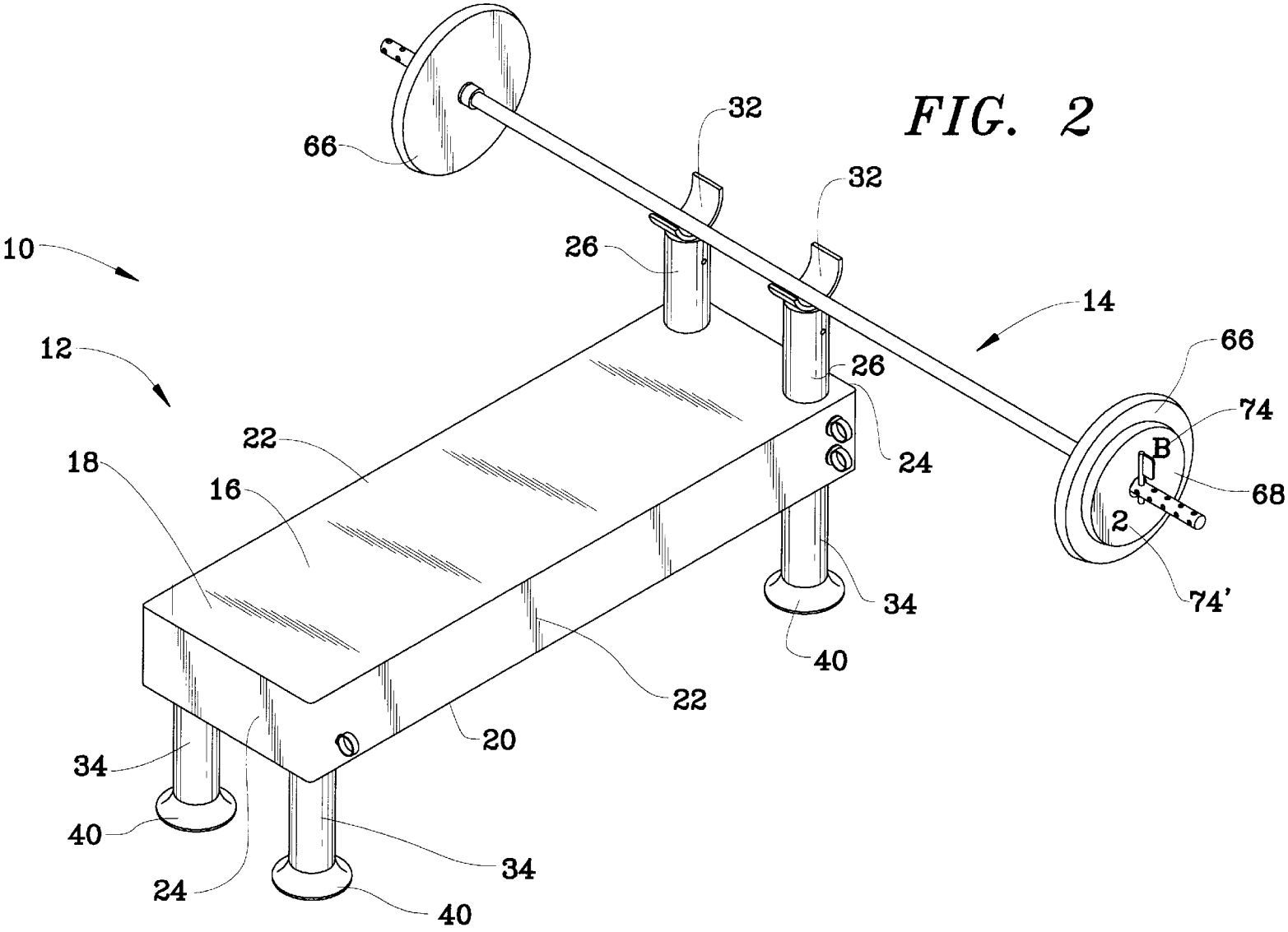
FIG. 2 is a pictoral view of the combination shown in FIG. 1, shown assembled.

Now with reference to FIGS. 1 and 2, the chest muscle exercise simulator toy set combination according to the present invention is shown. The combination 10 includes a plastic bench construction 12 adapted to selectively support an associated plastic lifting rod assembly 14.

The bench construction 12 is designed to support the weight of a child during simulated bench press-style motions. The bench construction 12 includes an essentially-rectangular support platform 16 having a top surface 18 and an opposite bottom surface 20. The platform 16 is bounded by sidewalls 22 and endwalls 24 that extend orthogonally between the top and bottom surfaces 18,20.

A pair of prop arms 26 extends upward from the support platform 16. More specifically, the support platform top surface 18 includes a pair of recessed prop arm receiving cavities 28, and the prop arms 26 each include an insertion end 30 sized to fit therein. The prop arms 26 also include contoured free ends 32.

Support legs 34 extend orthogonally downward from the support platform 16. As with the prop arms 26, the support legs 34 each include an insertion end 36 sized to fit within one of four support leg receiving cavities 38 disposed within the support platform bottom surface 20. The support legs 34 free ends 40 are flared to provide stable contact with the ground beneath the bench construction 12. Additionally, the support legs 34 are located at the corners of the platform to further enhance the stability of the bench 12. Although the present embodiment includes two prop arms 26 and four support legs 34, other combinations may be used as required by weight or size constraints.

In keeping with the objects of the present invention, the prop arms 26 and support legs 34 are removable. With reference to FIG. 3, the prop arm insertion ends 30, the prop arm receiving cavities 28, and the support platform sidewalls 22 are perforated to allow insertion of prop arm securing pins 42 through the sidewalls, into the support platform 16. The prop arm securing pins 42 selectively lock the prop arm insertion ends 30 within the prop arm receiving cavities 28. Similarly, the support legs 34 are removably pinned within the support leg receiving cavities 38. The support leg insertion ends 36, the support leg receiving cavities 38, and the support platform sidewalls 22 are perforated to allow insertion of support leg securing pins 44 trough the sidewalls, into the support platform 16.

The support leg securing pins 44 increase the stability of the bench construction by ensuring that the support legs 34 are positioned correctly within the support leg receiving cavities 38. Both sets of securing pins 42,44 have the same shape. The distal or insertion end 46,46' of each pin 42,44 is rounded for safety, and the proximal end 48,48' of the pins is looped for easy handling. This pin arrangement advantageously allows children to assemble or disassemble the bench construction 12 without needing tools or requiring adult supervision.

The bench construction 12 is designed to be stable even if the securing pins 42,44 are not used. The receiving cavities 28,38 are deep enough to securely engage the prop arm and support leg insertion ends 30,36, regardless of securing pin presence. Although the securing pins 42,44 minimize unwanted motion during use, use of the toy set 10 may continue in the event that the securing pins become lost or broken. Because this set 10 is designed primarily for use by children, who may inadvertently misplace or damage the securing pins 42,44, the present design extends the useable life of the device.

The lifting rod assembly 14 included in the set 10 is designed for cooperative use with the bench construction 12. As shown in FIG. 1, the lifting rod assembly 14 includes an elongated bar 50 that is divided into three regions: a middle region 52 flanked by a first mounting region 54 and a second mounting region 56. Raised positioning rings 58 mark the boundaries of the middle region 52. The positioning rings 58 may be formed integral with the elongated bar 50 or the rings may be separate elements affixed separately to the bar. In the present embodiment, the positioning rings 58 are adjustably attached by adhesive, allowing the relative sizes of the mounting regions 54,56 and the middle region 52 to be customized.

With additional reference to FIG. 4, the first and second mounting regions 54,56 are each characterized by spaced-apart retention pin bores 60. The retention pin bores 60 pass transversely through the central axis of the elongated bar 50. Each retention pin bore 60 is sized to accept one of two included retention pins 62. The retention pins 62 are rigid cylinders each having a handling tab 64 extending therefrom. The handling tab 64 allows easy grasping by little fingers.

The lifting rod assembly 14 also includes a collection of large discs 66 and small discs 68 slidably deposed on the mounting regions 54,56. Each disc 66,68 includes a centrally-disposed mounting aperture 70 passing therethrough. The diameter of the mounting apertures 70 is such that the discs 66,68 pass freely along the bar mounting regions 54,56, but the positioning rings 58 prevent the discs from sliding into the bar middle region 52. The retention pins 62 and the positioning rings 58 cooperate to restrict longitudinal motion of the discs 66,68 once the discs have been placed on the bar 50.

In use, one disc of each type 66,68 is placed onto each of the mounting regions 54,56, with the bar 50 passing through the mounting aperture 70 of each disc 66,68. The discs 66,68 are then slid along the mounting regions toward the center of the bar, until they either come to rest against one of the positioning rings 58 or abut an already-mounted disc 68. The discs 66,68 are also preferably marked with size-indicating indicia. The large discs 66 are each labeled with a letter "A" 72 and the number "1" 72'. The small discs 68 are each labeled with a letter "B" 74 and the number "2" 74'. These indicia may be stickers applied to the discs 66,68 or may be elements formed integral with the discs. In the present embodiment, the indicia are formed integral with the discs 66,68. Additionally, discs 66,68 of each size are different colors. Collectively, the indicia and colors advantageously help children develop symbol and color recognition during playtime.

As shown in FIG. 1, once the discs 66,68 are in place on the bar 50, the retention pins 58 are inserted into appropriate retention pin bores 60. In this way, discs 66,68 are securely, yet removably, mounted on the bar 50; the positioning rings 58 and retention pins 62 work in a sandwich-type relationship to selectively prevent sliding of the discs along the bar. Once the pins 62 are in place, the elongated bar 50 is placed upon the prop arm contoured free ends 32. At this point, the set 10 is ready for use.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. A children's weight lifting set for simulating chest muscle exercises, said children's weight lifting set comprising:

a plastic bench construction including a support platform having a top surface with a plurality of prop arm cavities, and a bottom surface having a plurality of support leg cavities; a plurality of prop arms sized to engage said prop arm cavities, and a plurality of support legs sized to engage said support leg cavities;

an elongated plastic bar including a first mounting region that is spaced apart from a second mounting region by a middle region, said middle region bounded by a pair of positioning rings disposed on said bar, said mounting regions being characterized by a plurality of retention pin bores that pass transversely therethrough;

a plurality of plastic plates removably disposed on said mounting regions, said plates sized to abut said positioning rings yet move freely along said bar mounting regions; and a plurality of rigid plastic retention pins sized to frictionally engage said retention pin bores, each retention pin including a handling flange extending therefrom.

2. The weight lifting set of claim 1, wherein:

said prop arms are removably pinned into said prop arm cavities, and said support arms are removably pinned into said support leg cavities.

3. The weight lifting set of claim 1, wherein:

at least one of said plates has a first set of predetermined outer dimensions, at least one of said plates has a second set of predetermined outer dimensions, and each of said plates includes size-indicating indicia.

4. The weight lifting set of claim 1, wherein:

at least one of said plates has a first set of predetermined outer dimensions, at least one of said plates has a second set of predetermined outer dimensions, said plates having said first set of predetermined dimensions being formed from a first predetermined color, and said plates having said second set of predetermined dimensions being formed from a second predetermined color.

5. A children's weight lifting set for simulating chest muscle exercises, said children's weight lifting set consisting essentially of:

a plastic bench construction including a support platform having a top surface with a plurality of prop arm cavities, and a bottom surface having a plurality of support leg cavities; a plurality of prop arms sized to engage said prop arm cavities, and a plurality of support legs sized to engage said support leg cavities;

an elongated plastic bar including a first mounting region that is spaced apart from a second mounting region by a middle region, said middle region bounded by a pair of positioning rings disposed on said bar, said mounting regions being characterized by a plurality of retention pin bores that pass transversely therethrough;

a plurality of plastic plates removably disposed on said mounting regions, said plates sized to abut said positioning rings yet move freely along said bar mounting regions; and a plurality of rigid plastic retention pins sized to frictionally engage said retention pin bores, each retention pin including a handling flange extending therefrom.

6. The weight lifting set of claim 5, wherein:

said prop arms are removably pinned into said prop arm cavities, and said support arms are removably pinned into said support leg cavities.

7. The weight lifting set of claim 5, wherein:

at least one of said plates has a first set of predetermined outer dimensions, at least one of said plates has a second set of predetermined outer dimensions, and each of said plates includes size-indicating indicia.

8. The weight lifting set of claim 5, wherein:

at least one of said plates has a first set of predetermined outer dimensions, at least one of said plates has a second set of predetermined outer dimensions, said plates having said first set of predetermined dimensions being formed from a first predetermined color, and said plates having said second set of predetermined dimensions being formed from a second predetermined color.

* * * * *